US008176614B2

(12) United States Patent
Welch

(10) Patent No.: US 8,176,614 B2
(45) Date of Patent: May 15, 2012

(54) DRAWER-TYPE DISHWASHER HAVING MODULAR SUPPORT BODY

(75) Inventor: Rodney M. Welch, Beach Bluff, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 157 days.

(21) Appl. No.: 12/582,099

(22) Filed: Oct. 20, 2009

(65) Prior Publication Data

US 2010/0037447 A1 Feb. 18, 2010

Related U.S. Application Data

(62) Division of application No. 11/407,115, filed on Apr. 20, 2006, now Pat. No. 7,624,745.

(51) Int. Cl.
*B23P 19/00* (2006.01)

(52) U.S. Cl. ..... 29/428

(58) Field of Classification Search ..... 134/200, 134/56 D; 29/428; 68/3 R
See application file for complete search history.

(56) References Cited

U.S. PATENT DOCUMENTS

| | | | | | |
|---|---|---|---|---|---|
| 2,216,388 | A * | 10/1940 | Hampel | 134/47 |
| 2,661,750 | A * | 12/1953 | McNairy | 134/115 R |
| 3,826,553 | A * | 7/1974 | Cushing et al. | 312/351.3 |
| 6,571,808 | B2 * | 6/2003 | Todd | 134/58 D |
| 6,997,195 | B2 * | 2/2006 | Durazzani et al. | 134/58 D |
| 2004/0244825 | A1 * | 12/2004 | Ashton | 134/85 |

FOREIGN PATENT DOCUMENTS

| | | | |
|---|---|---|---|
| DE | 25 18 994 | * | 4/1975 |
| DE | 33 37 369 | * | 4/1985 |
| JP | 2002-315710 | * | 10/2002 |
| JP | 2003-180605 | * | 7/2003 |

* cited by examiner

*Primary Examiner* — Frankie L Stinson
(74) *Attorney, Agent, or Firm* — Robert A. Bacon; Diederiks & Whitelaw, PLC

(57) ABSTRACT

A dishwasher includes a tub having a bottom wall and a plurality of side walls that collectively define a first washing chamber. The tub is supported in an outer, modular support body having first and second opposing side walls joined by a bottom wall, as well as a pair of upper frame members. In one embodiment of the invention, first and second support bodies are mounted one atop another to establish a dual drawer-type dishwasher, with the first and second support bodies being joined, preferably at a stepped interface region, by a plurality of brackets. The first and second support bodies are preferably aligned by arranging lugs formed on upper in-turned flanges on a lower support body within recesses formed in the bottom wall of the upper support body.

13 Claims, 5 Drawing Sheets

DRAWER-TYPE DISHWASHER HAVING MODULAR SUPPORT BODY

CROSS-REFERENCE TO RELATED APPLICATIONS

The present application represents a divisional of U.S. patent application Ser. No. 11/407,115, filed Apr. 20, 2006 entitled "DRAWER-TYPE DISHWASHER HAVING MODULAR SUPPORT BODY", pending.

BACKGROUND OF THE INVENTION

1. Field of the Invention

The present invention pertains to the art of dishwashers and, more particularly, to a modular support body for a drawer-type dishwasher that can be employed to form a single compartment drawer-type dishwasher or stacked with another modular support body to form a multi-compartment dishwasher.

2. Discussion of the Prior Art

In general, dishwashers having pull-out drawers supported in a cabinet are known in the art. The dishwasher may include a single pull-out drawer or, in some cases, the dishwasher is constructed as a dual unit having an upper pull-out drawer forming a first wash tub for washing dishware, and a lower pull-out drawer forming a second wash tub that can be used to supplement the first wash tub. In any event, known drawer-type wash tubs are mounted to extensible rails that are carried by or mounted to an enclosed cabinet. Typically, the cabinet is positioned under a kitchen countertop adjacent cabinetry or other kitchen appliances.

Manufacturers of home appliances face a highly competitive market. Thus, there is a constant struggle to reduce both the number and complexity of various parts of the appliance, as well as lower costs associated with manufacturing, without detracting from an established level of quality. One method found to reduce both the number of parts and manufacturing costs is to re-evaluate the design of fundamental components used to construct the appliance. One area of investigation has focused on the enclosed cabinet and associated structure.

Given that a dishwasher is placed under a kitchen countertop adjacent cabinetry, walls or other appliances, there is really no need to provide a fully enclosed cabinet. In recognition of this fact, manufacturers of conventional dishwashers have done away with enclosed cabinets and developed an assembly which mounts a washing tub on minimal support structure which is then positioned under a countertop and secured in place. While this solution is fine for conventional dishwashers, drawer-type dishwashers require specific structure for supporting extensible rails that enable one or more wash tubs to slide in and out. In general, it has been the practice to form a drawer-type dishwasher with an outer cabinet which encloses a slidable drawer and is specifically constructed in dependence on the number of drawers in the overall dishwasher.

Regardless of the known prior art, there still exists a need for a low cost, easily manufactured modular support body for a drawer-type dishwasher that includes specific structure for supporting a laterally movable washing chamber. More specifically, there exists a need for a modular dishwasher support body that can be employed either as a single unit or readily joined to a second modular dishwasher support body to form a multi-compartment unit.

SUMMARY OF THE INVENTION

The present invention is directed to a dishwasher including a tub having a bottom wall and a plurality of side walls that collectively define a washing chamber. A lid is shiftably mounted relative to the tub to selectively provide access to the washing chamber in order to allow a consumer to load and unload dishware. In accordance with the invention, the tub is mounted in a modular, outer support body that includes first and second opposing side walls which are interconnected by a bottom wall and a pair of upper frame members. The side walls, bottom wall and frame members collectively define a tub receiving cavity having exposed top and rear portions.

In further accordance with the invention, the outer support body includes a plurality of channels formed in each of the first and second side walls and the bottom wall. The plurality of channels extend along an outer surface of each sidewall, between a top edge portion and a bottom edge portion and along the bottom wall. As such, each of the plurality of channels establishes a corresponding raised portion on an internal surface of each side and bottom wall. The channels provide structural support for the modular support body and also serve as attachment points for the frame members. In accordance with the most preferred form of the invention, each of the frame members is substantially U-shaped, having first and second end sections that are joined by an intermediate section. Preferably, the first and second end sections are secured to the raised portions, with the intermediate sections spanning a top portion of the outer support body.

In accordance with one embodiment of the invention, the dishwasher includes first and second washing chambers or tubs and, correspondingly, first and second outer support bodies. The first and second outer support bodies are preferably, identically constructed and positioned one atop the other, while being connected by a plurality of brackets. Preferably, the first and second opposing side walls of each of the first and second outer support bodies taper inward from the top edge portion to the bottom edge portion. With this construction, when the first and second outer support bodies are positioned atop one another, the bottom edge portions of the first and second side walls of the first outer support body are spaced inward from the top edge portions of respective ones of the first and second side walls of the second outer support body, thereby establishing a stepped interface region. The plurality of brackets are preferably angled so as to nest into the stepped interface regions when joining the first and second outer support bodies. In accordance with one aspect of the invention, the outer support body is provided with first and second flanges which extend laterally inward from the top edge portion. The flanges provide additional structural support and preferably include lugs which aide in aligning the outer support bodies when positioned one atop the other.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
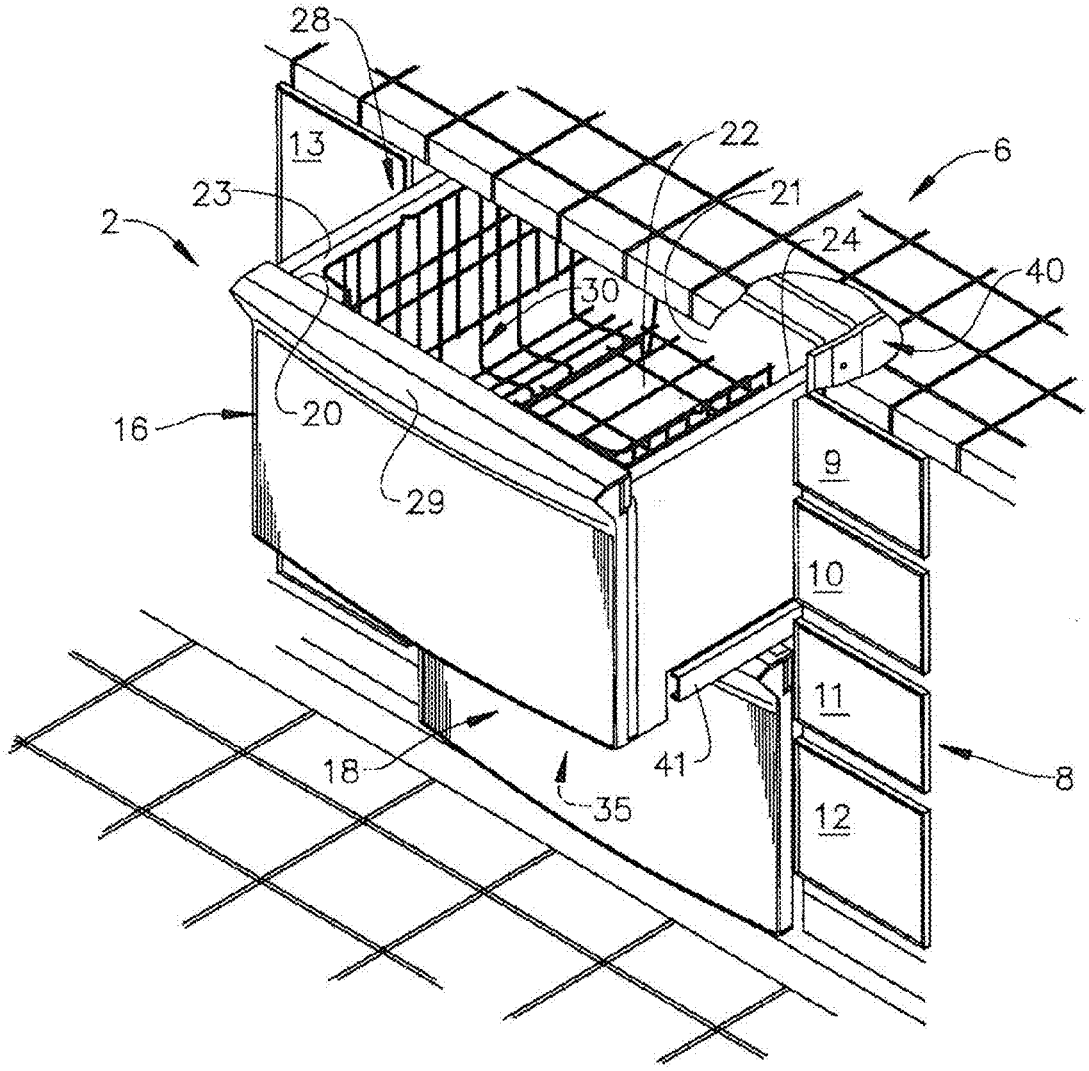
FIG. 1 is an upper right perspective view of a dishwasher incorporating modular outer support bodies constructed in accordance with the present invention.

With initial reference to FIG. 1, a dishwasher constructed in accordance with the present invention is generally indicated at 2. As shown, dishwasher 2 is arranged below a kitchen countertop 6. Also below kitchen countertop 6 is shown cabinetry 8 including a plurality of drawers 9-12, as well as a cabinet door 13. As will become fully evident below, the present invention may be employed to form both single and multi-compartment dishwashers, with the invention being shown in connection with dishwasher 2 depicted as a multi-compartment dishwasher having an upper washing unit or drawer 16 and a lower washing unit or drawer 18.

In accordance with the embodiment shown, upper drawer 16 includes a front wall 20, a rear wall 21, a bottom wall 22 and opposing side walls 23 and 24 that collectively define an upper wash chamber or tub 28. In a manner known in the art, upper drawer 16 is provided with a handle 29 that enables a consumer to readily access tub 28 to add or remove items to be washed. In a manner also known in the art, tub 28 includes a dish rack 30 for supporting various objects, such as glassware, utensils and the like, to be exposed to a washing operation. In a similar manner, lower drawer 18 defines a correspondingly constructed tub 35. As will be discussed more fully below, upper drawer 16 is slidably mounted within a modular outer support body 40 through a pair of extendible drawer support glides or rails, one of which is indicated at 41. In addition, upper drawer 16 is provided with a vertically shiftable lid member (not shown) that is adapted to selectively seal against an upper portion (not separately labeled) of tub 28. More specifically, when upper drawer 16 is inserted into outer support body 40, the lid member is lowered to seal about tub 28 and, when upper drawer 16 is withdrawn from outer support body 40, the lid member is caused to be raised so as to enable drawer 16 to be readily withdrawn from outer support body 40 thereby providing access to tub 28. In any event, as the particular manner in which the lid member is raised or lowered does not form part of the present invention, this aspect of dishwasher 2 will not be detailed further here. Instead, the present invention is particularly directed to a preferred construction of outer support body 40.

Figure 2:
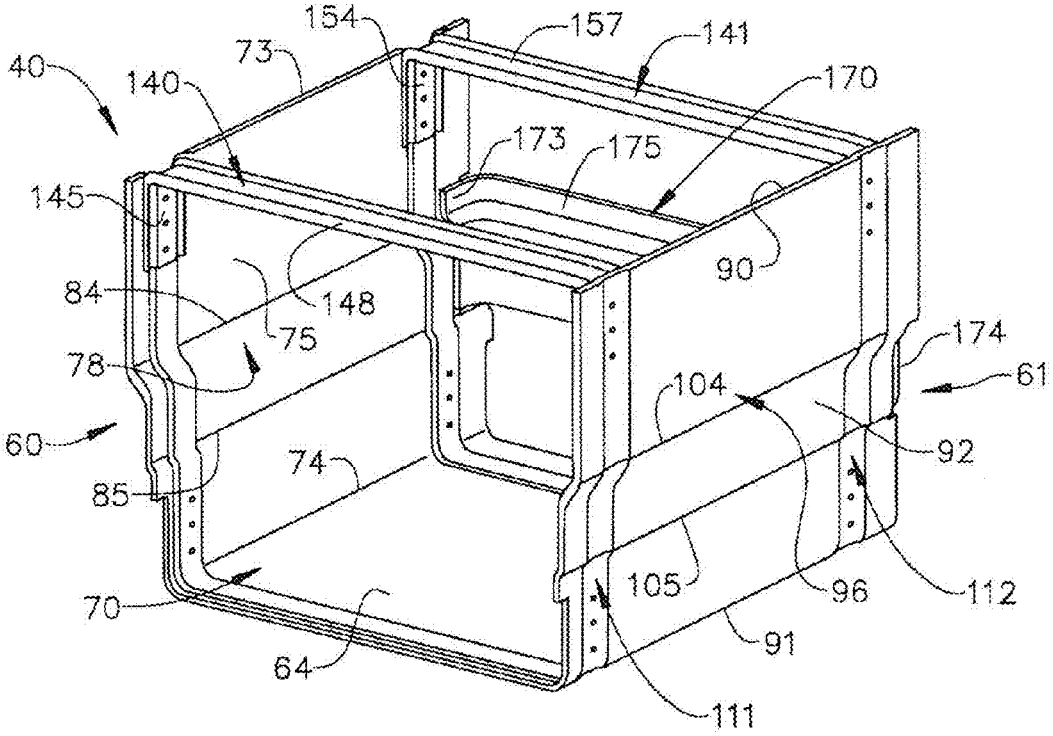
FIG. 2 is an upper right perspective view of an outer support body of the present invention.
Figure 3:
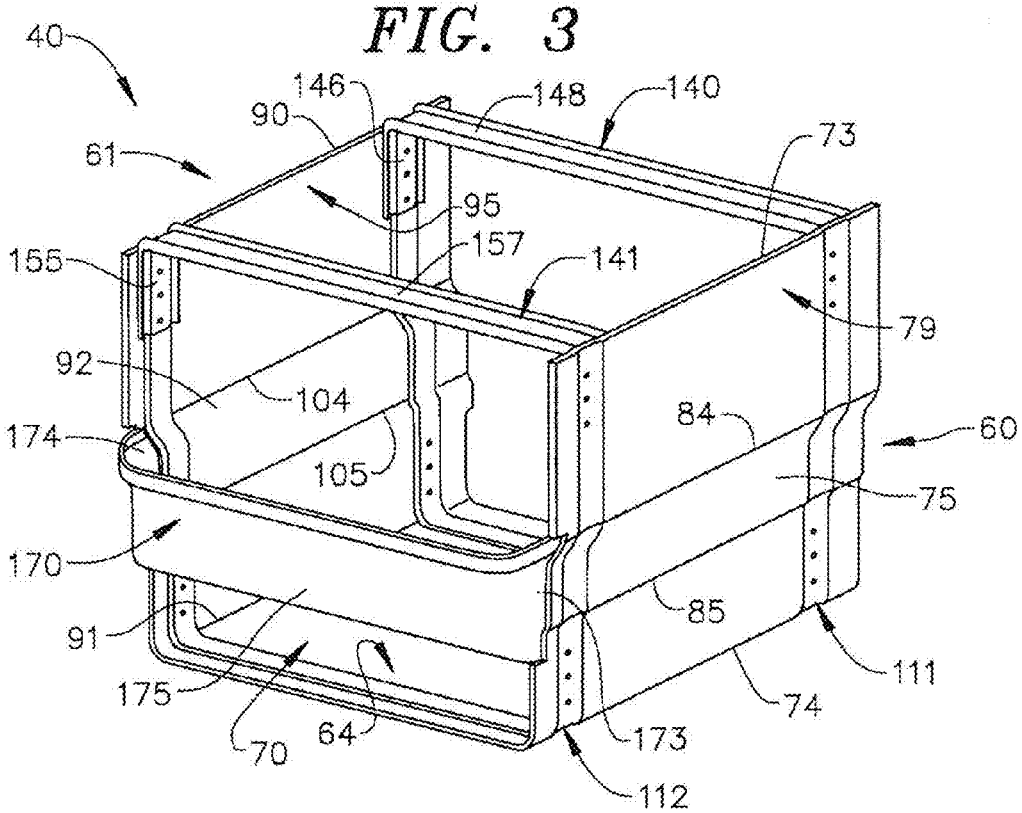
FIG. 3 is a upper right rear perspective view of the outer support body of FIG. 2.
Figure 4:
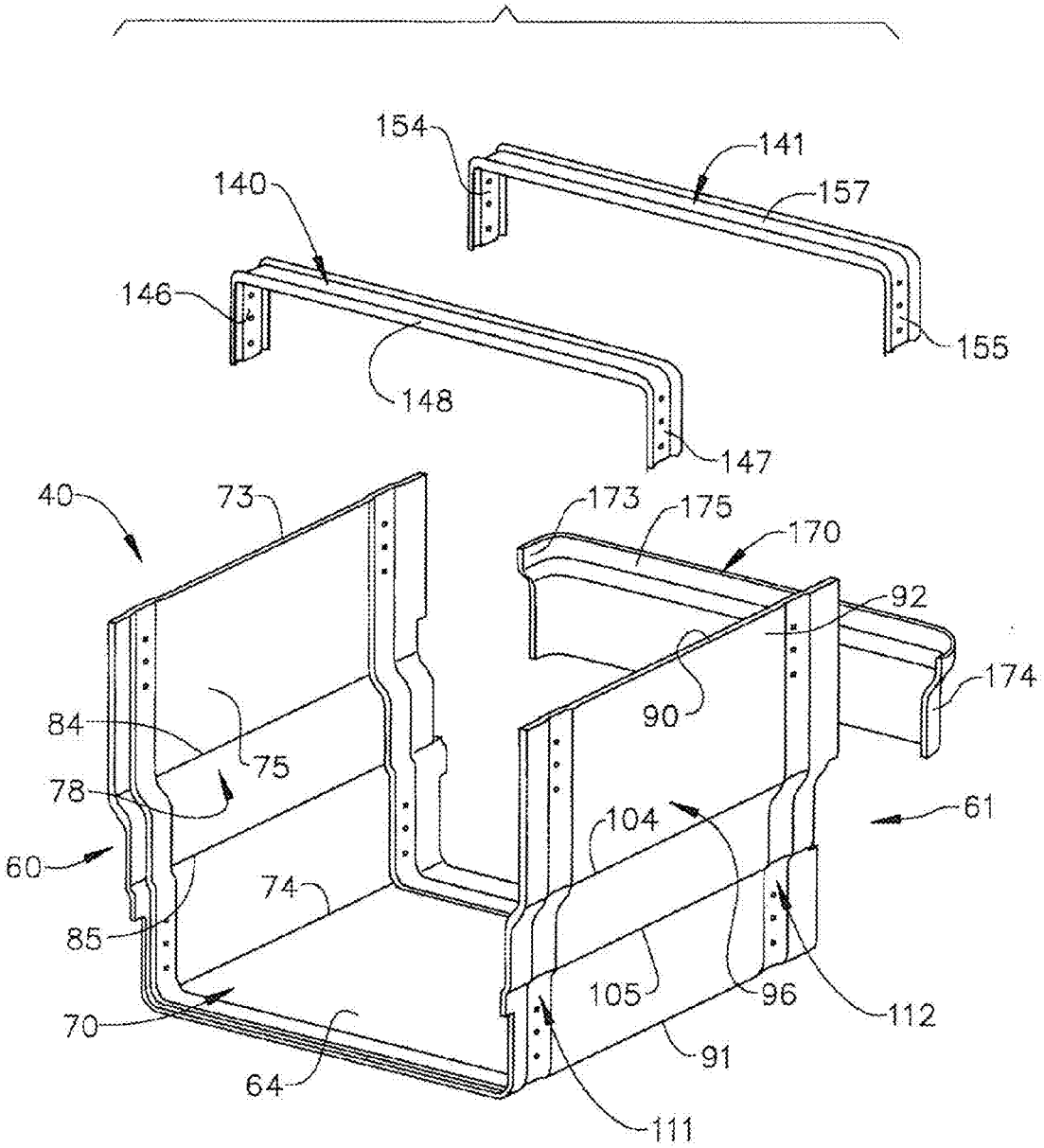
FIG. 4 is an exploded view of the outer support body of FIG. 2.

As best shown in FIGS. 2-4, outer support body 40 includes first and second opposing side walls 60 and 61 which are connected by a bottom wall 64 so as to define a tub receiving cavity 70. As shown, first side wall 60 includes a top edge portion 73, a bottom edge portion 74 and an intermediate portion 75 that define an inner surface portion 78 and an outer surface portion 79. As shown, side wall 60 tapers inward from top edge portion 73 towards bottom edge portion 74. Preferably, the taper is achieved by providing a pair of bends or folds 84 and 85 in intermediate portion 75. In addition to creating the taper, bends 84 and 85 provide a measure of structural support to side wall 60.

In a similar manner, second side wall 61 includes a top edge portion 90, a bottom edge portion 91 and an intermediate portion 92 which collectively define inner and outer surface portions 95 and 96. In a manner also similar to that described above, side wall 61 tapers from top edge portion 90 towards bottom edge portion 91, with the taper being provided or achieved through a pair of bends or folds 104 and 105. Preferably, first and second opposing side walls 60 and 61 and bottom wall 64 are integrally formed form a single sheet of metal so as to define a unitary, multi-sided tub body. In order to provide increased support to outer support body 40, a pair of depressions or channels 111 and 112 are formed in outer surface portions 79 and 96 of side walls 60 and 61, as well as across bottom wall 64. Actually, depressions or channels 111 and 112 extend from top edge portion 73 of first side wall 60, along intermediate portion 75, across bottom portion 64 and back up along second side wall 61, prior to terminating at top edge portion 90. In addition to providing increased structural stability or rigidity to outer support body 40, channels 111 and 112 define mounting structure for additional stiffening components in a manner that will be detailed more fully below.

In accordance with a preferred form of the invention, outer support body 40 includes first and second upper frame members 140 and 141 which extend between and are interconnected with first and second side walls 60 and 61 so as to create an exposed top portion for tub receiving cavity 70. In any case, first upper frame member 140 is shown to include first and second leg members 146 and 147 which are interconnected by a cross member 148. In accordance with the invention, leg members 146 and 147 are secured at an upper portion of channel 111 adjacent top edge portions 73 and 90 of side walls 60 and 61 respectively. Upper frame member 140 is secured through, for example, mechanical fasteners (not shown), spot welding or other known metal to metal fastening techniques. Likewise, second upper frame member 141 includes first and second leg members 154 and 155 which are joined by a cross member 157. First and second leg members 154 and 155 are joined to side walls 60 and 61 at second channel 112 adjacent top edge portions 73 and 90 respectively. Actually, leg members 145, 147 and 154, 155 cooperate with raised portions of channels 111 and 112. That is, as channels 111 and 112 are formed in outer surface portions 79 and 96, corresponding raised portions (not separately labeled) are formed in inner surface portions 78 and 95, with upper frame members 140 and 141 being shaped to extend about and be secured through these raised portions.

Additional structural stability is provided by a U-shaped rear frame member 170 which extends between first and second side walls 60 and 61 at a rear portion (not separately labeled) of support body 40. Towards that end, rear frame member 170 is provided with first and second end portions 173 and 174 that are joined by an intermediate portion 175. First and second end portions 173 and 174 are secured in a manner commensurate with that described above with respect to first and second upper frame members 140 and 141, while providing an exposed rear portion to modular support body 40 as clearly shown in FIGS. 2 and 3.

Based on the above description, it should be readily apparent that outer support body 40 constructed in accordance with the invention provides a simple and advantageous structure that is both mechanically stable and modular. More specifically, the exposed upper and rear portions of outer support body 40 enable various hoses, conduits, utility connections and other dishwasher components (not shown) to be readily routed and mounted within outer support body 40, while also subsequently providing easy access to the components of dishwasher 2, without the need for any extensive disassembly, for repair or the like purposes.

Figure 5:
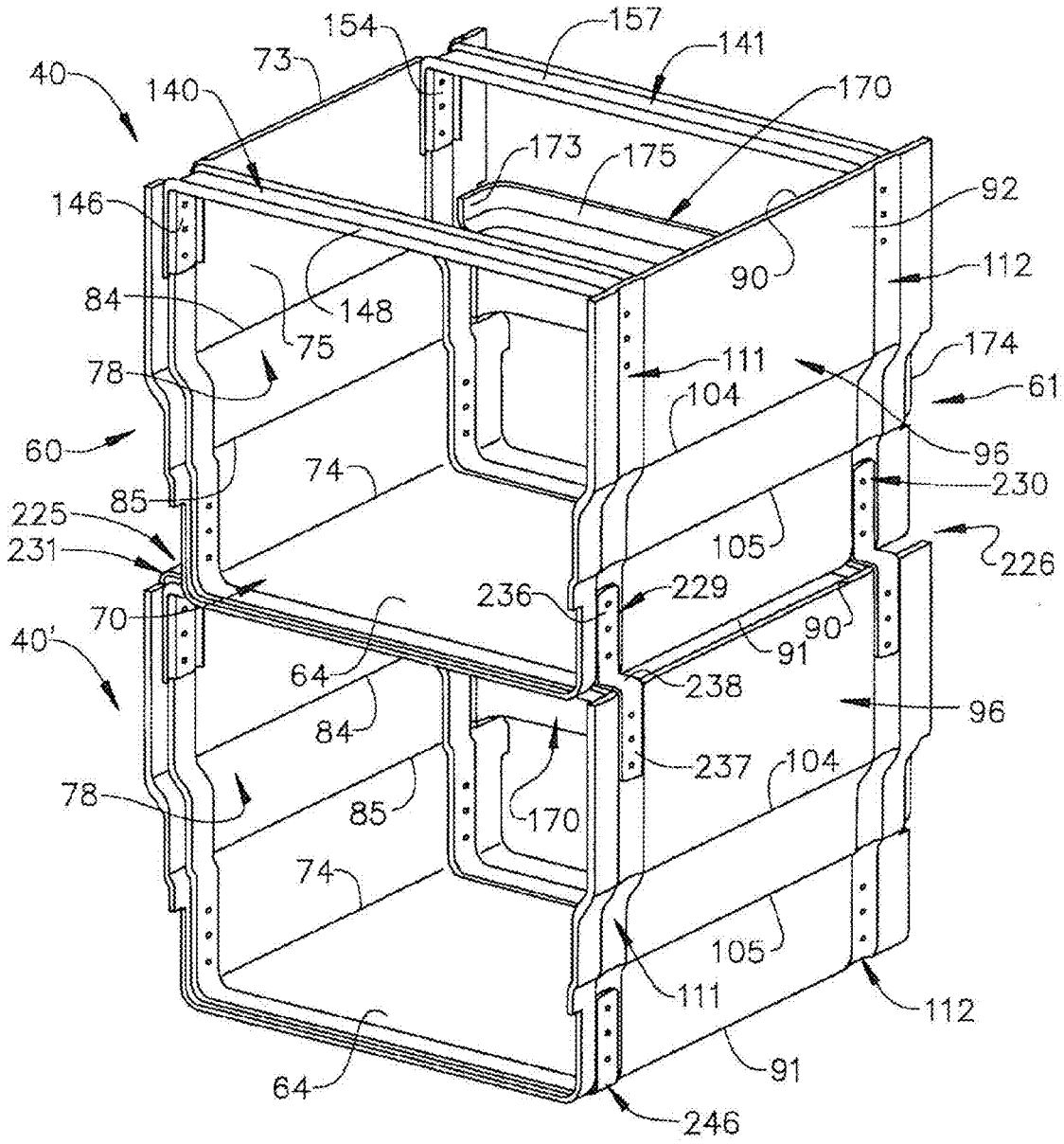
FIG. 5 is an upper right perspective view of the outer support body of FIG. 2 joined with a second outer support body to form a combined support body for a multi-compartment dishwasher.

Reference will now be made to FIG. 5 in describing another preferred embodiment of the present invention wherein outer support body 40 is mounted to a second outer support body 40'. In accordance with the invention, second outer support body 40' is preferably identically constructed to outer support body 40 such that like reference numbers represent corresponding parts in the respective views. As shown, outer support body 40 is stacked upon second outer support body 40'. Given the taper in side walls 60 and 61, bottom edge portions 74 and 91 of outer support body 40 are actually spaced inward from top edge portions 73 and 90 of outer support body 40' so as to form a pair of laterally stepped regions 225 and 226 at an interface of first and second outer support bodies 40 and 40'.

As indicated above, support bodies 40 and 40' are joined to form a multi-compartment dishwasher. More specifically, outer support body 40 is secured to outer support body 40' through a plurality of brackets, three of which are indicated at 229-231, with brackets 229 and 230 being provided at front and rear portions of stepped region 226 respectively, while bracket 231 is provided at a front portion of stepped region 225. Of course, it should be understood that a fourth bracket (not shown) is provided at a rear portion of stepped region 225. In any case, as each bracket 229-231 is preferably identically constructed, a detailed description will be made with respect to bracket 229 with an understanding that the remaining brackets are correspondingly constructed.

As shown in FIG. 5, bracket 229 includes a first or upper portion 236 that leads to a second or lower portion 237 through an angled portion 238. This construction forms a generally Z-shaped structure, with angled portion 238 nesting in stepped region 226. Preferably, first portion 236 is secured in channel 111 formed in outer support body 40 adjacent bottom edge portion 91, while second portion 237 is secured in channel 11 formed in outer support body 40' adjacent upper edge portion 90. In a manner similar to that described above, bracket 229 is fastened through known metal-to-metal connections, such as, for example, mechanical fasteners, spot welding or the like.

Figure 6:
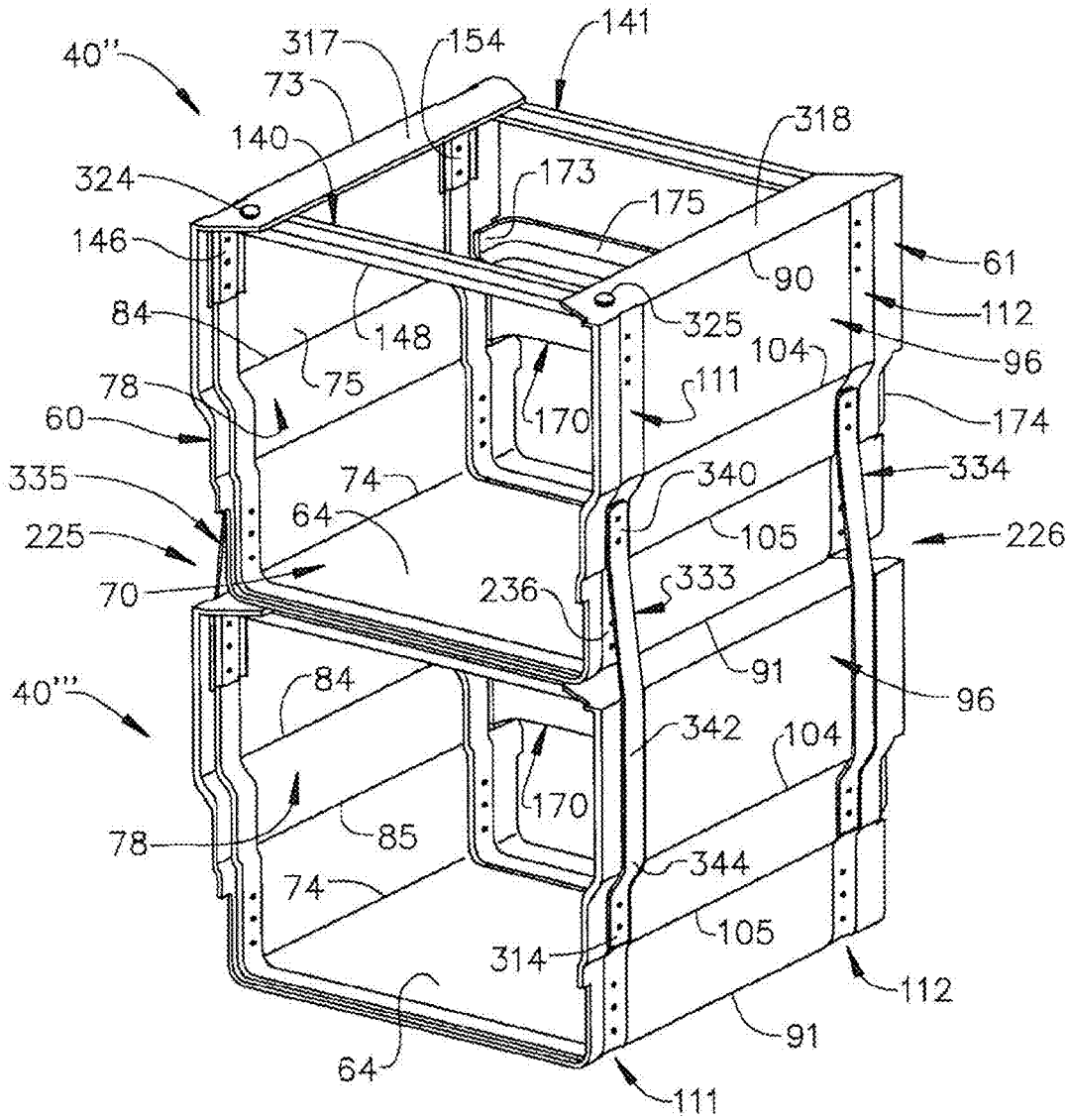
FIG. 6 is an upper right perspective view of outer support bodies, formed in accordance with another aspect of the present invention, joined together to form a combined support body for a multi-compartment dishwasher.

Reference will now be made to FIG. 6, wherein like reference numerals represent corresponding parts, in describing yet another embodiment of the present invention. As shown, an outer support body 40" is mounted to a second outer support body 40'". As each outer support body 40" and 40'" is preferably identically constructed, a detailed description will focus on outer support body 40" with an understanding that outer support body 40'" contains corresponding structure. Outer support body 40" includes first and second top brace or flange members 317 and 318 that extend laterally inward from top edge portions 73 and 90 respectively. Flange members 317 and 318 provide additional structural support to outer support body 40" to prevent parallelogramming and ensures proper mounting. That is, flange members 317 and 318 prevent outer support body 40" from leaning to one side or another which would create non-square angles for tub receiving cavity 70. In any case, each flange member 317, 318 includes a respective locating lug 324, 325. Locating lugs 324 and 325 of second outer support body 40'" are adapted to mate with corresponding recesses (not shown) formed adjacent a front edge of bottom portion 64 of outer support body 40". In this manner, locating lugs 324 and 325 ensure a proper alignment between outer support bodies 40" and 40'" during assembly.

In a manner similar to that described above, support bodies 40" and 40'" are joined to form a multi-compartment dishwasher. More specifically, outer support body 40" is secured to outer support body 40'" through a plurality of brackets, preferably four brackets with three of the brackets being indicated at 333-335. As shown, brackets 333 and 334 are provided at front and rear portions of stepped region 226 respectively, while bracket 335 is provided at a front portion of stepped region 225. A fourth bracket (not shown) is provided at a rear portion of stepped region 225. In any case, as each bracket 333-335 is substantially similar, a detailed description will be made with respect to bracket 333 with an understanding that the remaining brackets are substantially identically constructed.

In accordance with the embodiment shown, bracket 333 includes a first or upper portion 340 that leads to a second or lower portion 341 through an intermediate portion 342. Bracket 333 also includes a bend section 344 that corresponds to fold 104, allowing intermediate section to lie flat within channel 111. Upper portion 340 is secured, within a corresponding channel 111, to outer support body 40", while lower portion 341 is secured to outer support body 40'". In a manner also similar to that described above, bracket 333 is preferably fastened through known metal-to-metal connections, such as, for example, mechanical fasteners, spot welding or the like.

At this point, it should be understood that the present invention provides for a simple, cost effective means of constructing a support body for a drawer-type dishwasher that is both mechanically stable and modular such that multiple, identically constructed support bodies can be stacked and then joined together to form a multi-compartment dishwasher, while a single support body can also be utilized in establishing a single compartment unit. Although described with reference to preferred embodiments of the invention, it should be readily understood that various changes and/or modifications can be made to the invention without departing from the spirit thereof. For instance, additional stiffening members can be provided, such as a lower U-shaped member 246 shown extending between side walls 60 and 61, as well as along bottom wall 64. In addition, although having a unified side and bottom wall construction, each support body 40, 40', 40" and 40'" could be formed separate from side walls which are interconnected with a bottom wall. Further, although preferably formed from metal, support body 40, 40', 40" and 40'", as well as upper frame members 140 and 141 and rear frame member 170, could be formed from other materials, such as plastic. In general, the invention is only intended to be limited by the scope of the following claims.

I claim:

1. A method of assembling an outer support body of a drawer-type dishwasher comprising:

forming a first outer support body having first and second opposing side walls joined by a first bottom wall, wherein channels are established in each of the first and second opposing side walls of the first outer support body;

interconnecting upper portions of the first and second opposing side walls with a first pair of upper frame members positioned within and mounted at the channels of the first outer support body to establish a first tub receiving cavity;

forming a second outer support body having first and second opposing side walls joined by a second bottom wall, wherein channels are established in each of the first and second opposing side walls of the second outer support body;

interconnecting upper portions of the first and second opposing side walls of the second outer support body with a second pair of upper frame members positioned within and mounted at the channels of the second outer support body to establish a second tub receiving cavity;

stacking the first outer support body upon the second outer support body; and joining the first and second outer support bodies with a plurality of brackets.

2. The method of claim 1, further comprising: slidably installing first and second tubs into the first and second tub receiving cavities respectively.

3. The method of claim 1, further comprising:

interconnecting upper portions of the first and second opposing side walls of the first outer support body with a first rear frame member in establishing the first tub receiving cavity; and interconnecting upper portions of the first and second opposing side walls of the second outer support body with a second rear frame member in establishing the second tub receiving cavity.

4. The method of claim 1, further comprising: forming a flange that extends laterally inward from a top edge portion of one of the opposing side walls.

5. The method of claim 4, further comprising: providing a lug along an upper surface of the flange, said lug aiding in aligning the first and second outer support bodies relative to one another.

6. A method of assembling a drawer-type dishwasher comprising:

establishing an outer support body by:

interconnecting upper portions of respective first and second opposing side walls via a pair of upper frame members, wherein the first and second opposing side walls are joined by a bottom wall; and interconnecting the first and second opposing side walls via a rear frame member, wherein the first and second opposing side walls, the bottom wall, the pair of upper frame members and the rear frame member collectively define a tub receiving cavity having exposed top and rear portions; and mounting a tub for sliding movement into and out of the tub receiving cavity, the tub having a bottom wall and a plurality of side walls that collectively define a washing chamber.

7. The method according to claim 6, further comprising: providing each of the first and second opposing side walls with a plurality of channels.

8. The method according to claim 7, further comprising: providing the plurality of channels from a top edge portion, through an intermediate portion and to the bottom edge portion of each of the first and second opposing side walls.

9. The method according to claim 8, wherein interconnecting the upper portions of the respective first and second opposing side walls via the pair of upper frame members includes securing the pair of upper frame members within the plurality of channels.

10. The method according to claim 7, further comprising: providing the plurality of channels in an outer surface portion of each the first and second opposing side walls, while establishing corresponding raised portions on inner surface portions of the first and second opposing side walls.

11. The method according to claim 6, wherein the rear frame member is U-shaped, having first and second terminal end portions and an intermediate portion, and interconnecting the first and second opposing side walls via the rear frame member includes connecting the first and second terminal end portions to corresponding ones of the first and second opposing side walls.

12. The method according to claim 6, further comprising: providing a flange laterally inward from at least one of the first and second side walls.

13. The method according to claim 12, wherein the flange includes a lug and the method further comprises stacking the outer support body upon another outer support body, with the lug constituting an alignment member.

* * * * *